United States Patent [19]

Hiltwein et al.

[11] Patent Number: 4,947,748

[45] Date of Patent: Aug. 14, 1990

[54] SHEET GRIPPER ON SHEET-FED ROTARY PRINTING PRESSES

[75] Inventors: Hans-Peter Hiltwein, Phillippsburg; Willi Becker, Bammental, both of Fed. Rep. of Germany

[73] Assignee: Heidelberger Druckmaschinen AG, Heidelberg, Fed. Rep. of Germany

[21] Appl. No.: 371,281

[22] Filed: Jun. 26, 1989

[30] Foreign Application Priority Data

• Jun. 24, 1988 [DE] Fed. Rep. of Germany ..... 3821324

[51] Int. Cl.[5] ..... B41F 21/10

[52] U.S. Cl. ..... 101/409; 101/246

[58] Field of Search ..... 101/408, 409, 410, 246; 403/348, 349, 353; 267/175, 177

[56] References Cited

U.S. PATENT DOCUMENTS

| | | | |
|---|---|---|---|
| 3,151,552 | 10/1964 | Peyrebrune | 101/409 |
| 3,650,211 | 3/1972 | Nentwich | 101/409 |
| 4,372,209 | 2/1983 | Jentzsch et al. | 101/409 |
| 4,647,031 | 3/1987 | Smith et al. | 101/409 |
| 4,718,342 | 1/1988 | Raab et al. | 101/409 |
| 4,718,343 | 1/1988 | Gensheimer | 101/409 |

FOREIGN PATENT DOCUMENTS

| | | | |
|---|---|---|---|
| 493269 | 2/1930 | Fed. Rep. of Germany | 101/409 |
| 1236527 | 3/1967 | Fed. Rep. of Germany . | |
| 3418153 | 11/1984 | Fed. Rep. of Germany . | |
| 54-94402 | 7/1979 | Japan . | |
| 310177 | 4/1929 | United Kingdom | 101/409 |

*Primary Examiner*—Edgar S. Burr
*Assistant Examiner*—Joseph R. Keating
*Attorney, Agent, or Firm*—Herbert L. Lerner; Laurence A. Greenberg

[57] ABSTRACT

In a sheet-fed rotary printing press, a sheet gripper has a gripper finger and a gripper support, the gripper finger being swingable, in operating phase with the printing press, under the action of a gripper spring, into engagement with the gripper support and, against the action of the gripper spring, out of engagement with the gripper support, the gripper spring being supported at one end thereof against a counter-bearing on the gripper finger and, at the other end thereof, against a counter-bearing on a gripper housing, and includes a holding device separable from one another for fixing at least one of the counter-bearings, the holding device being in mutual agreement and being disposed on the counter-bearing as well as on a part of the printing press wherein the counter-bearing is mountable, the separable holding device being formed of an inner locking part and an outer locking part of a bayonet lock, at least one of the locking parts having projections and the other of the locking parts having holding surfaces for the projections, the projections and the holding surfaces being engageable with one another from behind by a movement of one of the locking parts against the action of the gripper spring and by a partial rotation of the one locking part.

4 Claims, 4 Drawing Sheets

Figure 2:
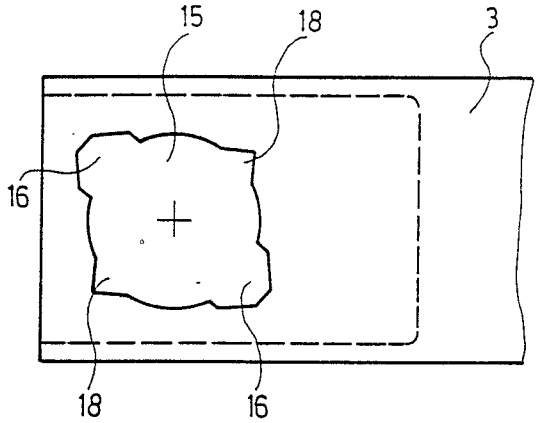

Fig. 1
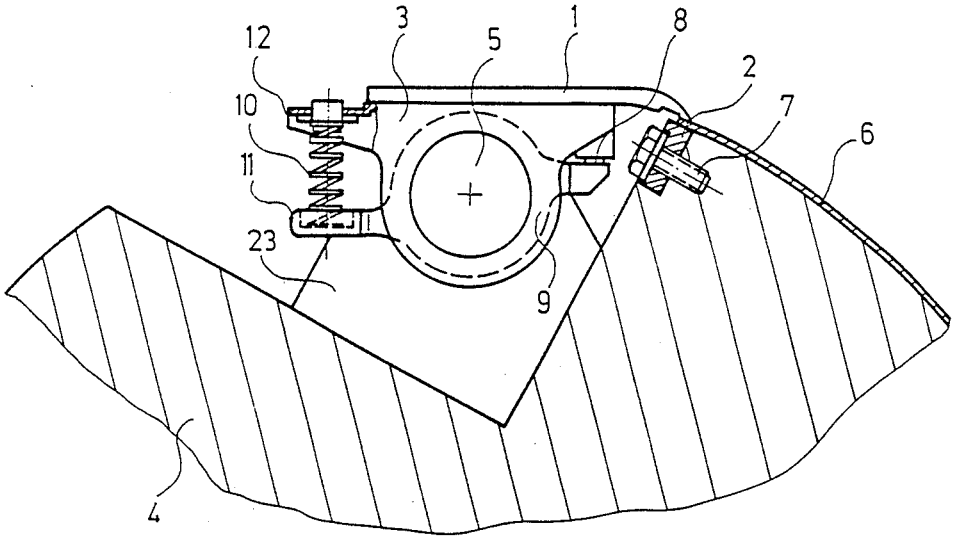
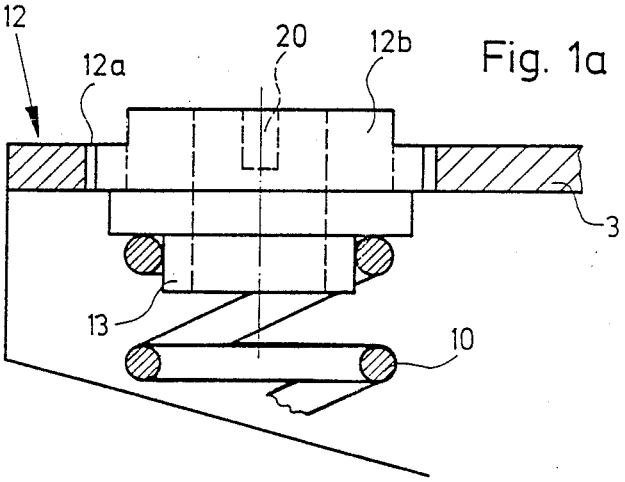
Fig. 1a

SHEET GRIPPER ON SHEET-FED ROTARY PRINTING PRESSES

The invention relates to a sheet gripper in a sheet-fed rotary printing press and, more particularly, to such a sheet gripper having a gripper finger and a gripper support, the gripper finger being swingable, in operating phase with the printing press, under the action of a gripper spring, into engagement with the gripper support and, against the action of the gripper spring, out of engagement with the gripper support, the gripper spring being supported at one end thereof against a counter-bearing on the gripper finger and, at the other end thereof against a counter-bearing on a gripper housing.

Sheet grippers with these features have become known heretofore from German Published Prosecuted Application (DE-AS) 12 36 527 and also from Japanese Patent 54-94402. In both cases, the gripper spring is braced at one end against a fixed counter-bearing on the body of the gripper finger and at the other end against a removable counter-bearing which is mounted on a gripper housing, so that the gripper spring can be inserted laterally and can, if necessary or desirable, also be removed again. The fixed counter-bearing on the body of the gripper finger is in the form of a depression, wherein one end of the gripper spring engages and is, thus, held against lateral displacement. The other counter-bearing is formed of a threaded pin, which is axially screwable into the housing in a female thread of a recess and which secures the other end of the gripper spring against radial movement either by engagement (DE-AS 12 36 527) or by overlapping (Japan 54-94402). This construction of the separable counter-bearing serves the purpose of facilitating the initial mounting or assembly of the gripper spring during the manufacture of the printing press and, if necessary or desirable, of facilitating re-mounting or re-assembly in the event of a break in the gripper spring. For the purpose of controlling or regulating the clamping force of the sheet gripper, it has become known from the aforementioned publications to provide the gripper support with a surface texture which supports or reinforces the holding force resulting from the clamping force and, possibly also, to form the mating surface of the gripper finger with a toothing, due to which, however, it is not possible for smooth printing materials to be held in register reliably. The aforementioned German publication, therefore, suggests that, in the gripper support, a pin be positioned which projects beyond the surface of the latter, the tip of the pin being disposed coaxially with a bore formed in the closed gripper finger, so that the sheet is locally given a deformation which improves the reliability of the in-register holding of the sheet in the closed sheet gripper. The replacement of the gripper spring is complex and also very time-consuming.

It is an object of the invention to provide a sheet gripper with an easily exchangeable gripper spring in order, thus, to be able to replace gripper springs in a relatively easy and time-saving manner and in order to be able to adjust the clamping force between the gripper finger and the gripper support by changing the spring tension as well as, if necessary or desirable, with the gripper springs removed, to be able to exchange the gripper support more easily than before.

With the foregoing and other objects in view, there is provided, in accordance with the invention, a sheet gripper having a gripper finger and a gripper support, the gripper finger being swingable, in operating phase with the printing press, under the action of a gripper spring, into engagement with the gripper support and, against the action of the gripper spring, out of engagement with the gripper support, the gripper support spring being supported at one end thereof against a counter-bearing on the gripper finger and, at the other end thereof, against a counter-bearing on a gripper housing, comprising holding means separable from one another for fixing at least one of the counter-bearings, set holding means being in mutual engagement and being disposed on the counter-bearing as well as on a part of the printing press whereon the counter-bearing is mountable, the separable holding means being formed of an inner locking part and an outer locking part of a bayonet lock, at least one of the locking parts having projections and the other of the locking parts having holding surfaces for the projections, the projections and the holding surfaces being engageable with one another from behind by a movement of one of the locking parts against the action of the gripper spring and by a partial rotation of the one locking part.

These structural features are based on the general idea of facilitating and speeding up the removal and re-installation of gripper springs in a sheet gripper as well as of assigning to the sheet gripper, for different clamping forces between the gripper finger and the gripper support, several gripper springs of different spring forces, it being possible for these gripper springs to be mutually exchanged for the purpose of varying the clamping force.

Thus, in the case of special printed materials, such as plastic sheets and printing inks with a high-degree of tackiness, it is possible to install a stronger gripper spring in order to increase the holding forces. If, conversely, in the case of thinner papers, the paper is penetrated when the grippers close, this can be prevented by the installation of weaker springs. Furthermore, the weak springs lead to lower stresses and strains in the printing press, due to which the wear on the parts of the press is reduced. In the case of paper distortion and a high degree of tackiness of the ink, respectively, in certain areas of the paper sheet, the sheet grippers of a cylinder can be equipped with springs of different strength. In order to achieve the same objective and in order to support this objective, respectively, it is also possible for the gripper supports easily to be exchanged, when the gripper springs are removed, in order to adapt the surface texture of the gripper support to different qualities of printed materials or in order to replace the gripper supports, if worn. Such work is normally performed by an assembler but can now also be carried out by the printer. The features of the invention, thus, permit the adaptation of the sheet grippers to the job structure of the printing shop and facilitate any necessary repairs.

The rapid removal and installation of the gripper springs is made possible primarily by the construction of the separable holding means between the removable counter-bearing of the gripper spring and the mounting or fastening part for the counter-bearing on the printing press.

The construction of the features according to the invention are implemented on the counter-bearing with which the gripper spring is braced on the gripper housing. Preferably suitable for the construction of the separable holding means are the structural features noted hereinabove in conjunction with bayonet-locks, plug-in connectors of a comparable type and other quick-release connectors. In this regard, in accordance with another feature of the invention, the inner locking part forms the counter-bearing for the gripper spring and has radially extending projections on the periphery thereof, the projections being insertible into a through-opening formed in the outer locking part, the outer locking part being disposed on the gripper finger and being formed with recesses complementary to the projections, the recesses being defined by segment-shaped stop surfaces for the projections.

In accordance with a further feature of the invention, the projections and the recesses are, respectively, two in number and are disposed in mirror-image symmetrical positions with respect to one another.

The counter-bearing may be installable and removable either with normal tools or with a special tool, which can be applied and removed, respectively, only when the counter-bearing is fixed or stationary. Such special tools are conventional in the case of printing presses.

With the tool, the gripper spring is compressed so that, by turning through a given angle of less than 360 degrees, the cams projecting from the pin or plug part are positioned behind the stop surfaces of the recess. By relaxing the spring, the cams are caused to latch into an indentation in the stop surfaces, so that the counter-bearing is fixed.

As will become apparent hereinafter, from the explanation of a preferred embodiment, the pin or plug part may be provided, either on the body of the gripper finger or on the gripper housing and, vice versa, the recess with the stop surfaces may be provided either on the gripper housing or an the body of the gripper spring. Providing the features according to the invention on both counter-bearings of the gripper spring is likewise conceivable.

In accordance with a concomitant feature of the invention, the outer locking part is formed, between the first-mentioned recesses, with diametrically opposite additional recesses at the periphery of the through-opening and the radially extending projections on the periphery of the inner locking part are formed with additional projections superimposed thereon and smaller than the first-mentioned projections, the additional projections being complementary to the additional recesses and being engageable in the recesses by the turning of the inner locking part with respect to the outer locking part.

Other features which are considered as characteristic for the invention are set forth in the appended claims.

Although the invention is illustrated and described herein as embodied in sheet gripper on sheet-fed rotary printing presses, it is nevertheless not intended to be limited to the details shown, since various modifications and structural changes may be made therein without departing from the spirit of the invention and within the scope and range of equivalents of the claims.

Figure 2A:
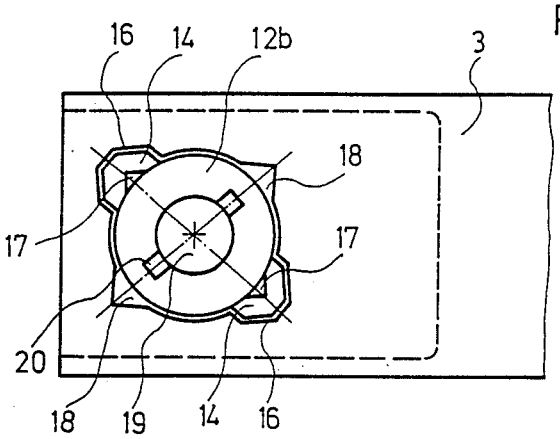
Figure 2B:
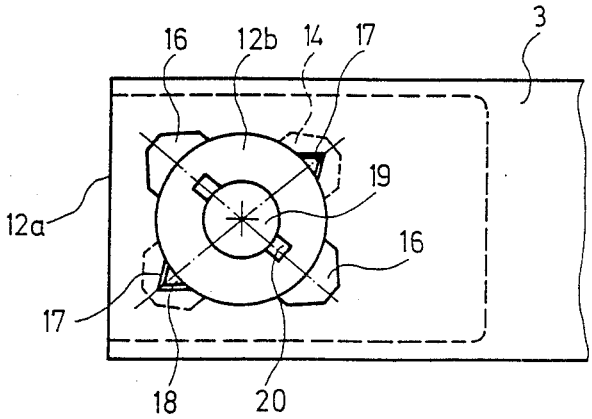
Figure 3:
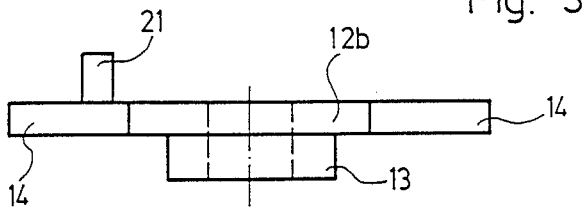
Figure 3A:
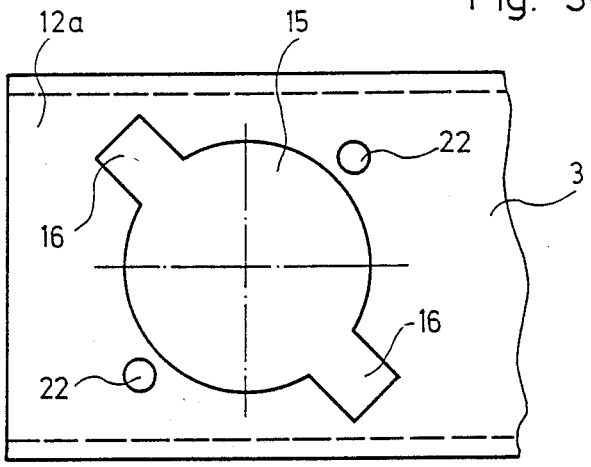
Figure 3B:
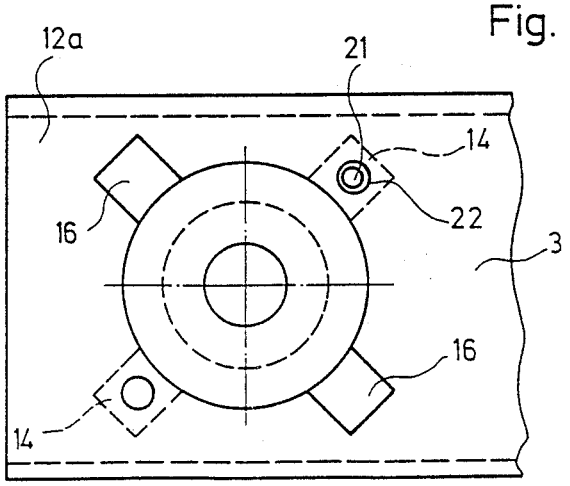
Figure 4:
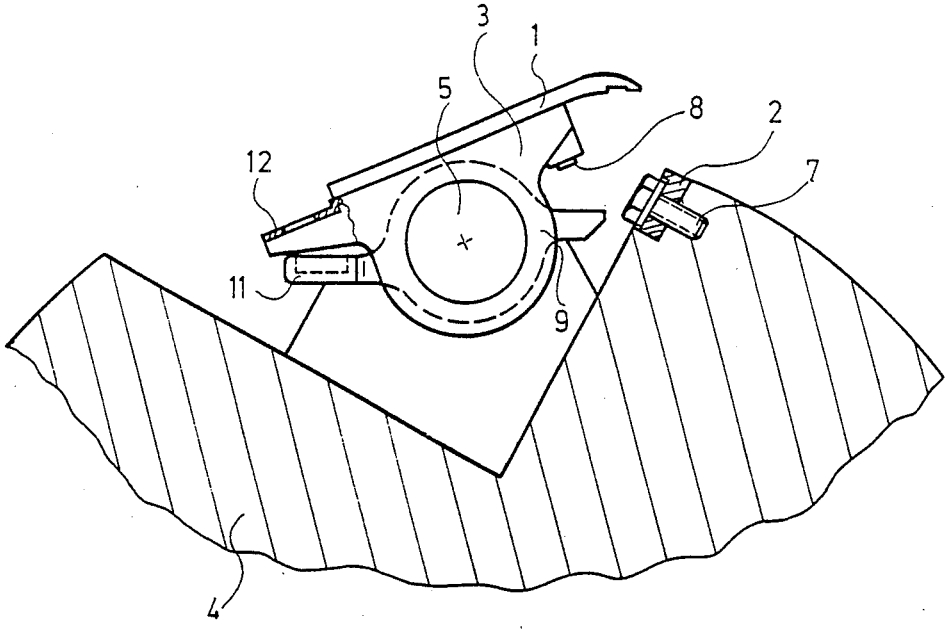

The construction and method of operation of the invention, however, together with additional objects and advantages thereof will be best understood from the following description of specific embodiments when read in connection with the accompanying drawings, in which:

FIG. 1 is a fragmentary cross-sectional view of a cylinder with a sheet gripper according to the invention shown thereon in a side elevational view;

FIG. 1*a* is a fragmentary, enlarged sectional view of FIG. 1 showing respective inner and outer locking parts of the sheet gripper;

FIG. 2 is a top plan view of FIG. 1*a* showing the outer locking part thereof with the inner locking part omitted;

FIG. 2*a* is a view like that of FIG. 2 additionally showing the inner locking part, in released condition, however;

FIG. 2*b* is a view like that of FIG. 2*a*, with the inner locking part in locked condition, however;

FIG. 3 is a side-elevational view of another embodiment of the inner locking part;

FIG. 3*a* is a top plan view of another embodiment of the outer locking part complementary to the inner locking part of FIG. 3;

FIG. 3*b* is a top plan view like that of FIG. 3*a* showing the inner locking part in locked condition thereof; and FIG. 4 is a view like that of FIG. 1 in another operating phase of the sheet gripper and wherein the gripper spring is removed.

Referring now to the drawing and, first, particularly, to FIG. 1 thereof, there is shown therein a sheet gripper according to the invention having a gripper finger 1, a gripper support or seat 2 and a gripper housing 3 is disposed by means of bearing locations 23 on a shaft 5 extending parallel to the longitudinal axis of the cylinder 4. The sequence of movements of the gripper housing 3 is controlled in phase with the working of the printing press, the gripping edge of a sheet 6 being gripped (FIG. 1) or released between the gripper finger 1 and the gripper seat or support 2, the gripper support being fastened to the cylinder 4 by bolts 7. The closing movement of the gripper finger 1 is limited by an adjustable stop 8 on the gripper housing 3 in cooperation with a counter-stop 9. The opening movement of the gripper finger 1 is performed against the action of a gripper spring 10, which is in the form of a helical spring and which is braced at one end against a counter-bearing 11 on the counter-stop 9 and, at the other end, against a counter-bearing 12 on the gripper housing 3. The counter-bearing 11 on the counter-stop 9 is formed at the base of a recess, into which one end of the gripper spring 10 is inserted. Conversely, the counter-bearing 12 on the gripper housing 3 for the other end of the gripper spring 10 has a bayonet lock formed of an outer locking part 12*a*, provided on the counter-bearing 12 itself, and of a loose locking part 12*b*, both of the locking parts 12*a* and 12*b* being formed of complementary recesses and projections, respectively, so that they are insertable into one another and can be locked together by turning in one direction and can be unlocked by turning in the opposite direction, respectively, the end of the gripper spring 10 facing towards the counter-bearing 12 being braced against the inner locking part 12*b*, the locking part 12*b* having a plug extension 13 (FIG. 1*a*) by which it projects into the gripper spring 10, thereby securing the latter against slipping laterally or sidewise.

In accordance with the embodiment shown in FIGS. 2, 2*a* and 2*b*, an inner locking part 12*b*, which is round as seen in a top plan view i.e. from above, is provided with a radially extending projection 14 at two preferably diametrically opposite points thereof, and the outer locking part 12*a*, formed on the gripper housing 3, is formed with a through-opening 15, which has recesses 16 profiled, as viewed from above i.e. in top plan view, in a manner complementary to the projections 14 and being of slightly larger dimensions, so that the inner locking part 12b can easily be pushed through together with the projections 14. The projections 14 are each formed with a further projection 17 of smaller dimensions, which cooperates with complementarily profiled recesses 18 formed on the periphery of the through-opening 15 and disposed angularly offset from the recesses 16, for example by 90 degrees, as is shown in FIG. 2. The inner locking part 12b, as is shown in FIG. 2a, is inserted from outside, i.e., from above, through the through-opening 15 and is pushed with the projections 14 through the recesses 16 against the action of the gripper spring 10 until the projections 14 are underneath the outer locking part 12a on the gripper housing 3, so that the inner locking part 12b can be turned relative to the outer locking part 12a. The inner locking part 12b continues to be turned thus until the position shown in FIG. 2b is reached, wherein the smaller projections 17, which are superimposed on the projections 14, are in alignment with the recesses 18 and engage in or latch into the recesses 18 due to the tension of the gripper 10. In the position, the larger projections 14 engage under the edge of the through-opening 15 in the outer locking part 12a. For this operation, the inner locking part 12b may be provided with suitable means for applying a common tool or a special tool. Shown in the drawing is a central bore 19 formed at the end face of the inner locking part 12b having a slight depth, the bore 19 being provided with two opposite, radially extending recesses 20 so that use can be made of a special tool formed of a straight pin or plug guiding the inner locking part 12b during its insertion, and lateral extensions, which engage in the recesses 20 for transmitting the turning movement from the tool to the inner locking part 12b.

Shown in FIGS. 3, 3a and 3b is a different embodiment of the inner locking part 12b (FIG. 3) and of the outer locking part 12a (FIG. 3a). A locking part 12a, which is round as viewed from above, i.e., in top plan view, is formed at its underside with a plug connection 13 which engages the end of the gripper spring 10 facing towards it. Two diametrically opposite and radially extending projections 14 formed on the locking part 12b have a rectangular profile, as viewed from above i.e. in top plan view. A pin or plug 21 is disposed on one of these projections 14. The locking part 12a formed on the gripper housing 3 has a through-opening 15 with two recesses 16 profiled so as to correspond to the projections 14 and, formed in the outer locking part 12a and offset at an angle to the recesses 16 is at least one bore 22, which is capable of accommodating or receiving therein the pin 21 formed on the inner locking part 12b. FIG. 3a shows two diametrically opposite holes 22, so that the inner locking part 12b. in order to achieve the locked condition, can be turned either in one or the other direction so as to permit the pin 21 to latch into or engage in one of the two bores 22 formed in the outer locking part 12a. The locked position is shown in FIG. 3b.

FIG. 4 shows a sheet gripper according to the invention in the open position thereof with the gripper spring removed. FIG. 4 illustrates the advantage afforded by the relatively easy exchangeability of the gripper support 2 when the gripper springs are removed. The bolts 7 holding the gripper support 2 are relatively easily accessible when the gripper housing 3 is swung away.

The foregoing is a description corresponding in substance to German Application 3821324, dated June 24, 1988, the International priority of which is being claimed for the instant application, and which is hereby made part of this application. Any material discrepancies between the foregoing specification and the aforementioned corresponding German application are to be resolved in favor of the latter.

We claim:

1. In a sheet-fed rotary printing press, a sheet gripper having a gripper finger, a gripper spring, a gripper housing and a gripper support, the gripper finger being swingable, in operating phase with the printing press, under the action of said gripper spring, into engagement with the gripper support and, against the action of the gripper spring, out of engagement with the gripper support, support means for the gripper spring comprising a pair of counter-bearings, the gripper spring being supported at one end thereof against one of said counter-bearings which is mounted on the gripper finger and, at the other end thereof, against the other of said counter-bearings on which is mounted said gripper housing, the invention further comprising holding means separable from one another for fixing at least one of the counter-bearings, said holding means being disposed on the counter-bearing as well as on a part of the printing press wherein the counter-bearing is mounted, said separable holding means being formed of an inner locking part and an outer locking part forming a bayonet lock, at least one of said locking parts having projections and the other of said locking parts having holding surfaces for said projections, said projections and said holding surfaces being engageable with one another by a movement of one of said locking parts against the action of the gripper spring and by a partial rotation of said one locking part.

2. Sheet gripper according to claim 1, wherein said outer locking part is formed with a through-opening, said inner locking part forming the counter-bearing for the gripper spring and having radially extending projections on the periphery thereof, said projections being insertable into said through-opening formed in said outer locking part, said outer locking part being disposed on the gripper finger and being formed with recesses complementary to said projections, said recesses being defined by segment-shaped stop surfaces for said projections.

3. Sheet gripper according to claim 2, wherein said projections and said recesses are, respectively, two in number and are disposed in mirror-image symmetrical positions with respect to one another.

4. Sheet gripper according to claim 2, wherein said outer locking part is formed, between said first-mentioned recesses with diametrically opposite additional recesses at the periphery of said through-opening, and said radially extending projections on the periphery of said inner locking part are formed with additional projections superimposed thereon and smaller than said first-mentioned projections, said additional projections being complementary to said additional recesses and being engageable in said recesses by said turning of said inner locking part with respect to said outer locking part.

* * * * *